US005305902A

United States Patent [19]

Vozick

[11] Patent Number: 5,305,902

[45] Date of Patent: Apr. 26, 1994

[54] METHOD AND APPARATUS FOR INTERCONNECTING VESSELS

[75] Inventor: David Vozick, Elmsford, N.Y.

[73] Assignee: AFP Imaging Corporation, Elmsford, N.Y.

[21] Appl. No.: 901,038

[22] Filed: Jun. 19, 1992

[51] Int. Cl.[5] ..... A47G 19/00

[52] U.S. Cl. ..... 220/23.4; 206/504; 206/509; 24/287; 248/213.2

[58] Field of Search ..... 220/23.4, 23.2; 24/287; 248/213.2; 206/504, 509

[56] References Cited

U.S. PATENT DOCUMENTS

| | | | |
|---|---|---|---|
| 863,536 | 8/1907 | Hudson . | |
| 1,186,991 | 6/1916 | Jamison | 220/23.2 |
| 1,212,864 | 1/1917 | Will | 220/23.2 |
| 1,564,282 | 12/1925 | Shipley . | |
| 2,495,132 | 1/1950 | Remco | 220/23.4 |
| 2,684,174 | 7/1954 | Schmitz . | |
| 3,343,706 | 9/1967 | Berend . | |
| 3,546,753 | 12/1970 | LaFont | 24/287 |
| 3,603,474 | 9/1971 | Erickson | 220/23.4 |
| 3,781,947 | 1/1974 | Germer | 24/287 |
| 3,811,595 | 5/1974 | Eckdahl et al. | 220/23.4 |
| 4,942,975 | 7/1990 | Capron et al. | 220/23.4 |
| 4,993,125 | 2/1991 | Capron et al. | 24/287 |

FOREIGN PATENT DOCUMENTS

| | | | |
|---|---|---|---|
| 480228 | 12/1969 | Switzerland | 220/23.4 |

*Primary Examiner*—Allan N. Shoap
*Assistant Examiner*—Paul A. Schwarz
*Attorney, Agent, or Firm*—Cooper & Dunham

[57] ABSTRACT

A method and apparatus is provided for interconnecting thin-walled vessels. Lip and groove alternatively disposed on the exterior upper edges of contiguous vessels fit together to interlock the vessels. Tensioning brackets provided with tension screw engage the contiguous vessels. Tightening the tension screw causes force to be exerted on the interconnected lip and groove, thereby providing a rigid connection between the vessels.

8 Claims, 4 Drawing Sheets

METHOD AND APPARATUS FOR INTERCONNECTING VESSELS

BACKGROUND OF THE INVENTION

The present invention relates to a method and apparatus for interconnecting several vessels, wherein a stable multi-vessel assembly with thin, rigidly connected walls is provided. The invention is particularly useful in assemblies and systems which require utilization of several different liquids in succession, such as the development of photographic film, or in the performance of a large scale process, such as the dyeing of cloth.

Methods for interconnecting various types of containers are known. However, none of the existing methods has been shown to be useful for creating a stable and rigid array of thin-walled vessels or tanks.

U.S. Pat. No. 3,343,706 to Berend discloses multiple drawers which can be connected to each other in varying positions via interlocking lips. The purpose of Berend is to provide flexible storage devices which can adapt to different storage areas.

U.S. Pat. No. 3,604,474 to Erickson discloses a sectional carrying case which can be interlocked with another carrying case via dovetailed tongue and groove formations on the sides of the respective cases. The carrying cases of Erickson are not designed to contain liquids.

U.S. Pat. No. 863,536 to Hudson relates to a skillet with two interlocking sides and interlocking handles which can be used to cook two different foods at once. The skillet and handle assemblies of each side connect via laterally extending members which interconnect at corresponding recesses.

U.S. Pat. No. 2,684,174 to Schmitz discloses the employment of a series of vertical ribs disposed along adjacent sides of fermentation tanks wherein the ribs line up parallel to each other and are secured to walls of adjacent tanks. Means for spanning the upper and lower ends of the ribs and securing the adjacent sides of the tanks also are disclosed.

A frame holding multiple ice cans is disclosed in U.S. Pat. No. 1,564,282 to Shipley. U.S. Pat. No. 3,811,595 to Eckdahl discloses interlocking serving trays.

Thus, it has not been known in view of the prior art to utilize a combination of interlocking lips and grooves at the upper portions of the vessels and interlocking tension bracket assemblies and bracket receptacles at the lower portions of the vessels to provide a rigid connection between adjacent thin-walled vessels intended to contain liquids.

SUMMARY OF THE INVENTION

One object of the present invention is to provide a means for interconnecting vessels intended to contain liquids.

Another object of the present invention is to provide a rigid connection between interconnecting thin-walled vessels intended to contain liquids.

Still another object of the present invention is to supply a simple means for exerting tensile and compressive forces to interlocking vessels intended to contain liquids such that a rigid connection is made and maintained between the vessels.

In accordance with the present invention, vessels are provided, along opposite exterior upper edges, with lip and groove means. At least two vessels are aligned such that the lip of one vessel engages a corresponding groove of a second, contiguous vessel. Many vessels can be connected together using the method and apparatus of the invention. The connection is made and maintained through application of tensile and compressive forces to each adjacent tank wall with such forces applied at the point where the lip and groove means interlock. These forces are applied by a tension system that incorporates a tension bracket assembly on one vessel and a bracket receptacle on the contiguous vessel.

The invention relates specifically to vessels intended to contain liquids. However, it is also applicable to other types of vessels where a rigid connection is required.

DETAILED DESCRIPTION

Figure 1:
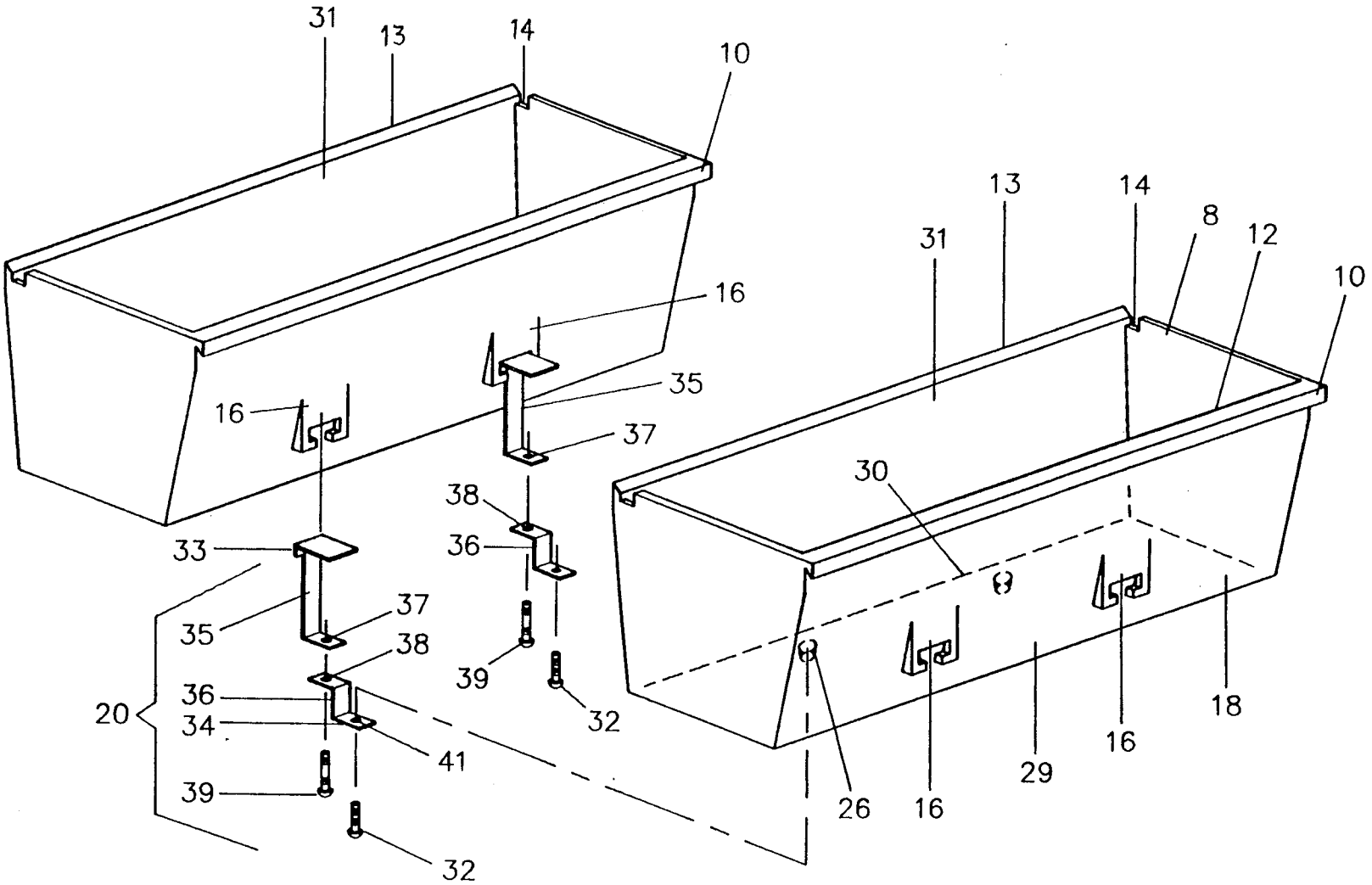
FIG. 1 is an exploded, perspective view of a pair of vessels modified in accordance with the present invention.
Figure 2:
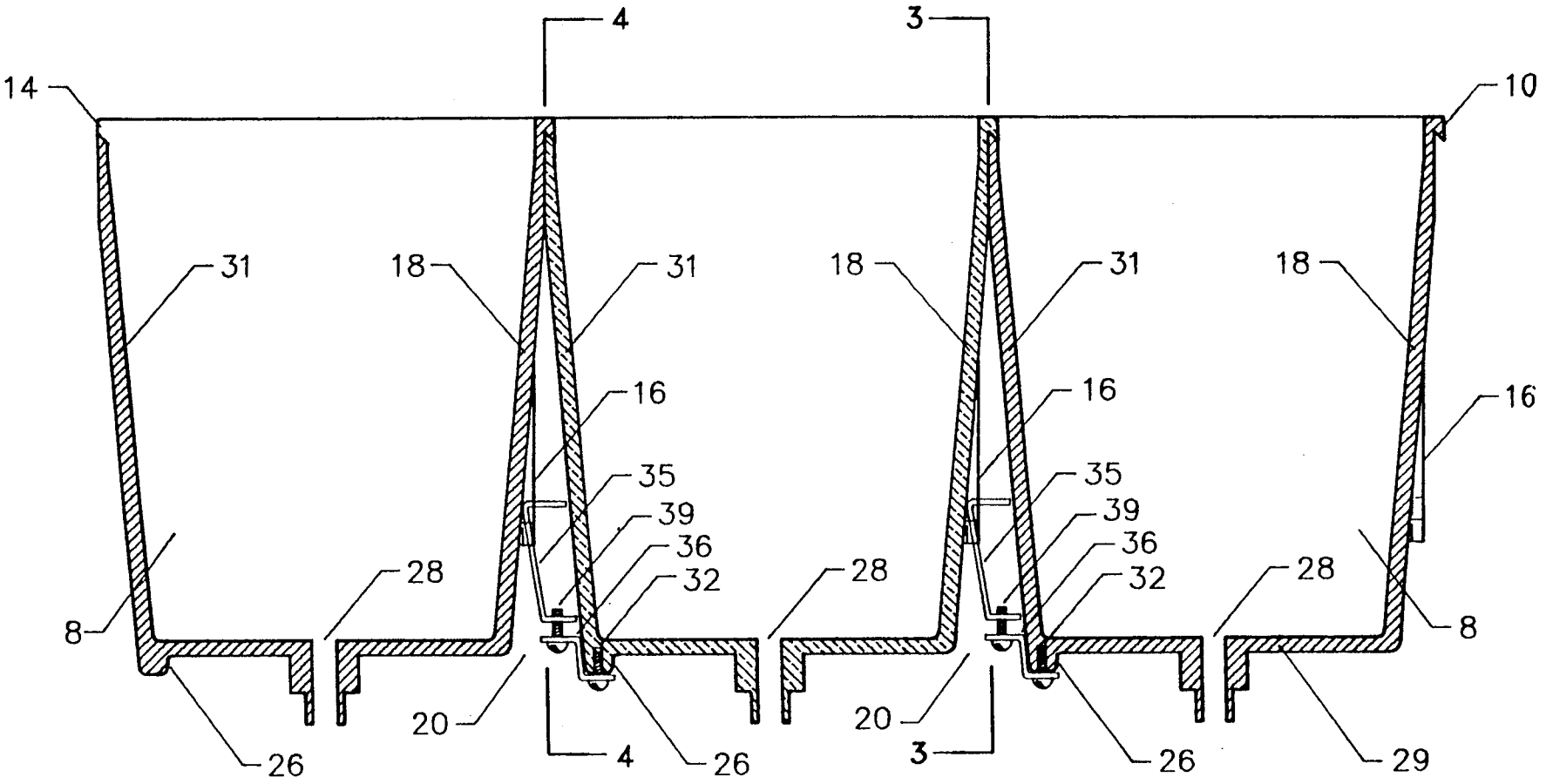
FIG. 2 is an elevational view of three vessels interconnected in accordance with the present invention.
Figure 3:
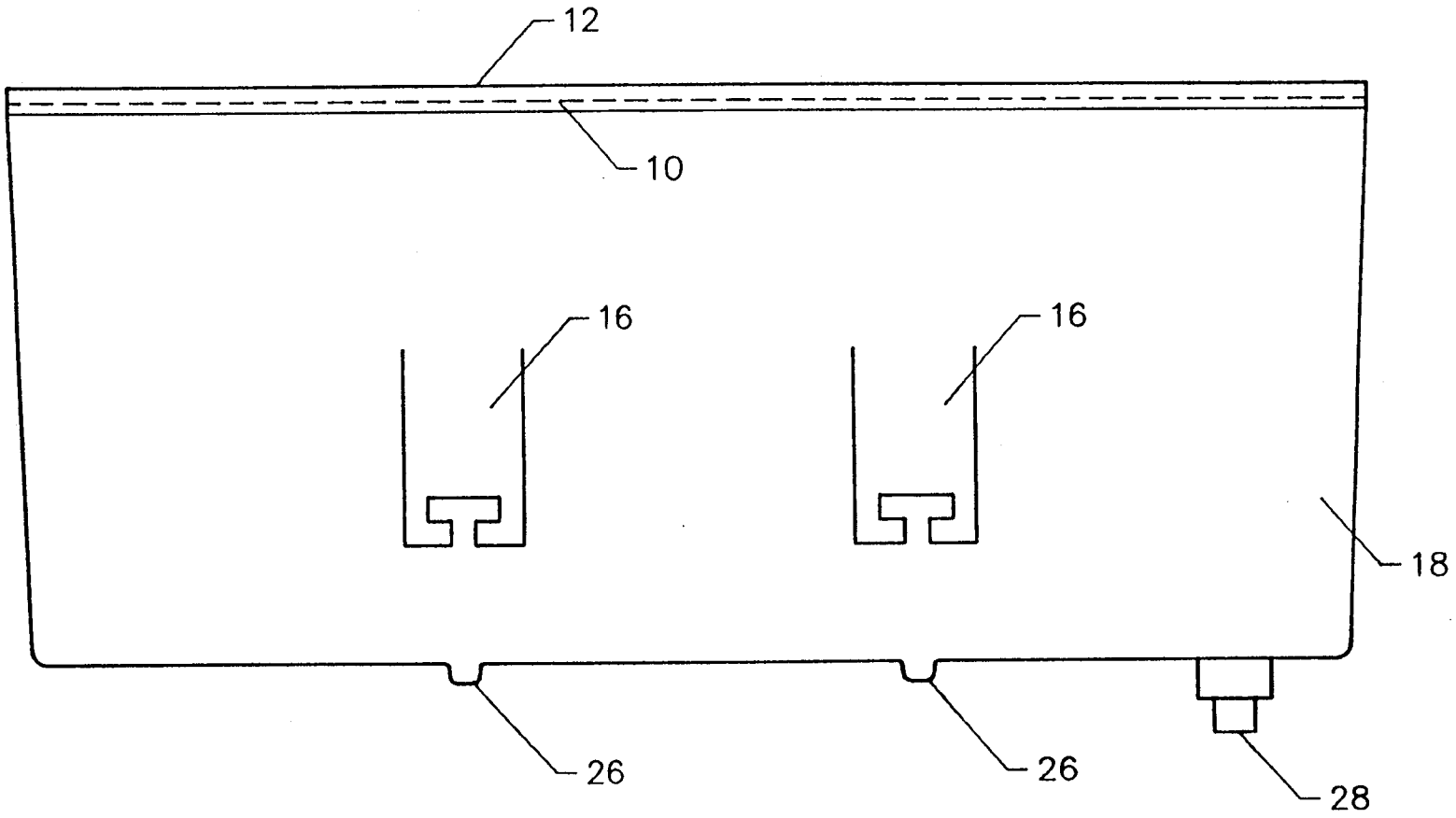
FIG. 3 is a right side elevational view of a vessel modified in accordance with the present invention.

Generally, as shown in FIGS. 1 and 2 of the drawings, the present invention relates to a method and apparatus for interconnecting vessels 8. The vessels 8 depicted are intended to contain liquids, and contain outlets 28 for the discharge of liquids. The invention also may be applicable to vessels designed to contain other materials, such as moist solids. In one embodiment, vessels 8 are made of a metal or metal alloy. Preferably, vessels 8 are formed of other materials, such as plastic, provided that the material has some flexibility. The invention is particularly applicable to thin-walled vessels.

An important feature of the invention is that vessels 8 are identical. Thus, they may be readily and inexpensively molded or formed, and the user need not be concerned with arranging different types of vessels in any predetermined array or order. Further, the system may be expanded to accommodate as many vessels 8 as may be necessary.

As best seen in FIG. 1, at least two vessels 8 are provided on first upper exterior edges 12 with wedge-shaped lip means 10. Each vessel 8 is provided on second upper exterior edges 13 with groove means 14. Lip means 10 and groove means 14 preferably are molded into vessels 8.

A bracket receptacle 16 is mounted on a first side wall 18 of each vessel 8. In the embodiment shown, bracket receptacle 16 is molded into side wall 18 of vessel 8. Alternatively, bracket receptacle 16 is separately manufactured and attached to the first side wall of each vessel 8 by screws. A waterproof adhesive also may be used to attach bracket receptacles 16 to vessels 8. As shown in FIG. 2, the number of bracket receptacles 16 located on each vessel 8 is a function of the length of vessel 8. For shorter vessels, one bracket receptacle 16 may be sufficient. For longer vessels, additional bracket receptacles 16 are necessary. In a preferred embodiment, one bracket receptacle 16 is provided for each foot of length of vessel 8.

Figure 4:
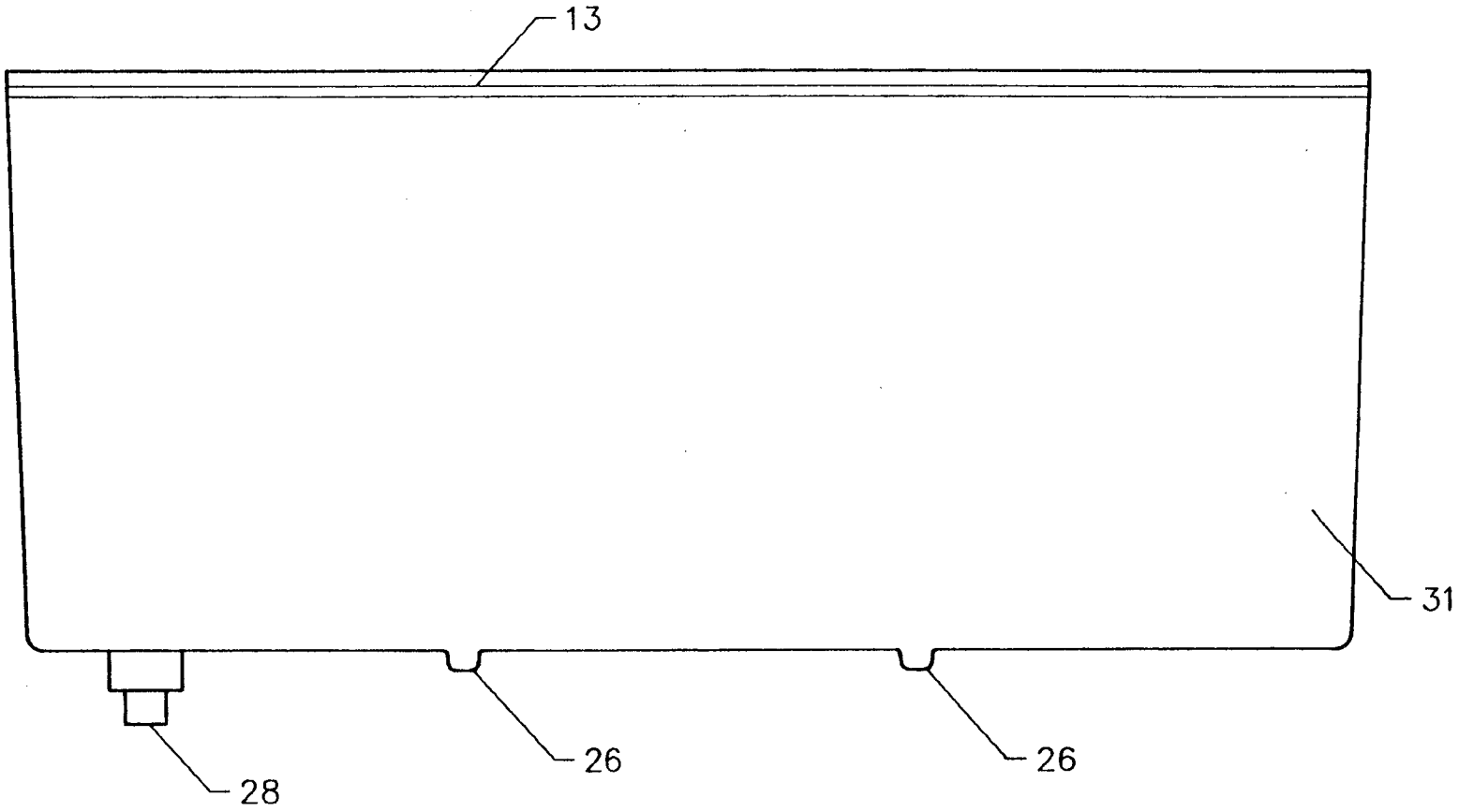
FIG. 4 is a left side elevational view of a vessel modified in accordance with the present invention.

Mounting socket 26 is located on underside edge 30 of vessel 8, essentially at the intersection of bottom 29 and second side wall 31. In one embodiment, shown in FIG. 4, mounting socket 26 comprises a threaded hole 42 adapted to receive screw 32. Mounting socket 26 corresponds to bracket receptacles 16, and the number of mounting sockets 26 provided for vessel 8 is dictated by the number of bracket receptacles 16 required for vessel 8.

Tension bracket assembly 20 is provided which contains flange 33, flange 34 and tension screw 39. In a preferred embodiment, tension bracket assembly 20 comprises C-bracket 35 and Z-bracket 36, connected together by tension screw 39 passing through holes 37, 38 in corresponding flanges 43, 44. Tension bracket assembly 20 preferably is made of a metal or metal alloy.

In use, as best seen in FIG. 2, at least two vessels 8 are arranged side by side such that first side wall 18 of a first vessel is parallel and contiguous to second side wall 31 of a second vessel 8. Lip means 10 of first vessel 8 is fitted into groove means 14 of second vessel 8 such that a loose connection is achieved between first and second vessels 8. Any number of vessels can be connected in this manner to form an array. Since vessels 8 are identical, the vessels may be arranged and connected in any order.

Flange 33 of tension bracket assembly 20 is placed into bracket receptacle 16 of first vessel 8. Where more than one bracket receptacle 16 is present on first side wall 18 of vessel 8, additional tension bracket assemblies 20 are provided, and this procedure is repeated for each bracket receptacle 16 and tension bracket assembly 20 pair.

Flange 34 of tension bracket assembly 20 is aligned with mounting socket 26 of second vessel 8 such that hole 41 of tension assembly means 20 is below and in contact with threaded hole 42 of mounting socket 26. Screw 32 is inserted through hole 41 into mounting socket 26 and tightened, thereby fastening tension assembly means 20 to second vessel 8. Where more than one tension bracket assembly 20 and mounting socket 26 are provided, this procedure is repeated for each tension assembly 20 and mounting socket 26.

Tension screw 39 on each tension bracket assembly 20 employed is tightened, thereby exerting force on interconnected lip means 10 and groove means 14 to create a rigid connection between first and second vessels 8. Tension screw 39 can be adjusted to regulate the amount of pressure exerted on the interconnection of lip means 10 and groove means 14. Where more than two vessels 8 are employed, the above procedure is repeated such that many identical vessels 8 are interconnected.

It should be appreciated that the specification and drawings depict one presently preferred embodiment of the invention. Other changes and modifications may be made, as would be apparent to those skilled in the art, without departing from the present invention.

I claim:

1. An apparatus for interconnecting at least two contiguous vessels for containing liquids, comprising:

a lip at the first upper exterior edge of each of said at least two said vessels;

a groove at a second upper exterior edge of each said at least two vessels, said lip of one said at least two contiguous vessels mating with said groove of the other said at least two contiguous vessels;

a first bracket receptacle attached to a first wall of each said at least two said vessels;

a second bracket receptacle attached to a second wall of each of said at least two said vessels;

a tension bracket assembly;

said tension bracket assembly mating with said first and second bracket receptacles of said at least two contiguous vessels;

means for interconnecting and tightening said tension bracket assembly to said first and second bracket receptacles;

whereby upon tightening said tension bracket assembly by said interconnecting means, said at least two contiguous vessels are interconnected at said first and second walls and at the same time force is exerted upon said lip and groove to rigidly interconnect said at least two contiguous vessels at said first and second wall exterior edges to form a rigid array of said at least two contiguous vessels.

2. The apparatus of claim 1, wherein said tension bracket assembly comprises two brackets interconnected by tension screw means.

3. The apparatus of claim 1, wherein each of said at least two contiguous vessels has thin walls and contains a liquid.

4. The apparatus of claim 1, wherein each of said first and second bracket receptacles is molded into each of said at least two contiguous vessels.

5. The apparatus of claim 1, wherein said lip and said groove are molded into each of said at least two contiguous vessels.

6. The apparatus of claim 1, wherein each of said at least two contiguous vessels comprises more than one of each of said first and second bracket receptacles and more than one of said tension bracket assembly.

7. The apparatus of claim 1, wherein each of said at least two contiguous vessels is identical.

8. A method of interconnecting at least two substantially identical thin-walled vessels, comprising the steps of:

arranging said at least two vessels side by side such that they are contiguous;

fitting a lip extending along an exterior edge of the first vessel of said at least two vessels into a groove extending along an exterior edge of the second contiguous vessel of said at least two vessels;

mating a tension bracket assembly attached to one of said at least two vessels to a bracket receptacle attached to the other of said at least two vessels to connect the two vessels; and tightening said tension bracket assembly to said bracket receptacle, thereby exerting force on said lip and groove to provide a rigid interconnection between said first and said second vessels and to provide a stable array of the thin-walled vessels.

* * * * *